US007264196B2

(12) United States Patent
Guay et al.

(10) Patent No.: US 7,264,196 B2
(45) Date of Patent: Sep. 4, 2007

(54) TOILET PAPER DISPENSER

(76) Inventors: Lambert Guay, 51 Rugar Park Way, Plattsburgh, NY (US) 12901; Rena Guay, 51 Rugar Park Way, Plattsburgh, NY (US) 12901

( * ) Notice: Subject to any disclaimer, the term of this patent is extended or adjusted under 35 U.S.C. 154(b) by 176 days.

(21) Appl. No.: 10/848,852

(22) Filed: May 20, 2004

(65) Prior Publication Data

US 2005/0029392 A1 Feb. 10, 2005

Related U.S. Application Data

(60) Provisional application No. 60/493,486, filed on Aug. 8, 2003.

(51) Int. Cl.
*B65H 16/04* (2006.01)

(52) U.S. Cl. ..... 242/597.2; 242/597.1; 242/597.8; 242/598.5

(58) Field of Classification Search ..... 242/590, 242/591, 592, 597.7, 597.8, 597.1, 597.2, 242/598, 598.2, 598.5, 597.4, 597.5; 248/125.1, 248/910

See application file for complete search history.

(56) References Cited

U.S. PATENT DOCUMENTS 364,855 A * 6/1887 Ratekin ..... 242/591
554,934 A * 2/1896 Johnson et al. ..... 242/591
742,883 A * 11/1903 Long ..... 242/591
821,999 A * 5/1906 Frost et al. ..... 242/592
1,186,027 A * 6/1916 Olson ..... 242/591
1,224,106 A 4/1917 Good
1,474,873 A * 11/1923 Woodward ..... 242/591
1,538,477 A * 5/1925 Epstein ..... 242/591
2,327,816 A 8/1943 Olson
2,374,103 A * 4/1945 Johnson ..... 242/591
3,022,024 A * 2/1962 Tishken ..... 242/591
3,370,805 A 7/1968 Barbee
3,407,980 A 9/1968 Addison
3,622,010 A 11/1971 Renelt
4,177,958 A 12/1979 Pole
2003/0226930 A1* 12/2003 Arcilesi ..... 242/597.4

* cited by examiner

*Primary Examiner*—William A. Rivera
(74) *Attorney, Agent, or Firm*—Mark Levy & Associates, PLLC

(57) ABSTRACT

The present invention provides ease of installation of toilet paper rolls on a vertical spindle sitting on a plate that prevents the unrolling of the paper. The floor free standing unit has a provision to store spare rolls on the pole, the spindle supports a decorative plate for decoration. A second unit is a wall mounted unit with a flex arm that could move the plate and spindle from right to left. A third is a wall mounted fixed unit. All three units are built with the same basic elements, plate and spindle. Each units' spindle supports a decorative plate.

8 Claims, 3 Drawing Sheets

TOILET PAPER DISPENSER

RELATED APPLICATIONS

The present application is a continuation-in-part application of U.S. provisional patent application, Ser. No. 60/493,486, filed Aug. 8, 2003, for TOILET PAPER DISPENSER, by Lambert Guay and Rena Guay, included by reference herein and for which benefit of the priority date is hereby claimed.

FIELD OF THE INVENTION

The present invention relates to toilet paper dispensers and, more particularly, to a toilet paper dispenser having a vertical spindle and a decorative plate.

BACKGROUND OF THE INVENTION

Since toilet paper dispensers existed there was never an easy way to install the toilet paper roll on the axle of the horizontal toilet paper holder which is desired by handicapped and the elderly people. Often the horizontal toilet paper holder is not wide enough to permit the installation of the axle without aggravation. Some horizontal toilet paper dispensers are too small to let the paper roll freely. Also, the axle is loose from the horizontal paper holder and made of more than one part that sometimes comes apart.

U.S. Pat. No. 4,177,958 Poole Dec. 11, 1979, Toilet Paper Service Pedestal offers an enclosed variety of dispensers.

U.S. Pat. No. 1,224,106 Good Apr. 24, 1917. is an individual spindle device to be attached on the wall.

U.S. Pat. No. 2,327,816 Olson Aug. 24, 1943. features a cylindrical cover with a slot having a serrated edge for tearing the paper.

U.S. Pat. No. 3,370,805 Barbee Jul. 27, 1968. shows a dispenser that stacks an extra roll of paper on a telescoping extension of the primary roll.

U.S. Pat. No. 3,407,980 Addison Sep. 29, 1968. dicloses an individual spindle device to be attached to the wall. U.S. Pat. No. 3,622,010 Renelt Nov. 23, 1971; Is a decorative U.S. Pat. No. 3,622,010 Renelt Nov. 23, 1971. is a decorative plumber helper that holds a spare roll of toilet paper by the toilet which is not a dispenser itself.

Prior dispensers do not offer the ease of installation to solve the problems that elderly and handicapped people have including persons affected by arthritis. The cited disclosures do not offer a free standing toilet paper dispenser and storage for spare of toilet paper rolls. The wall mounted units are fixed on the wall and the paper rolls down due to the small diameter resting plate. The wall mounted units do not move to allow better access to the toilet paper from different positions.

Bathrooms and half-baths exist in homes today. It is not at all uncommon that there is no convenient place to mount a conventional wall mounting toilet paper dispenser.

Interior decorations today should include accessibility of the toilet paper dispenser for the end user and should provide ease of free loading the toilet paper roll on the spindle.

It is therefore an object of the invention to make the installation of a toilet paper roll easier.

It is another object of the invention to remove the spring center axle that is provided with conventional toilet paper dispensers.

It is another object of the invention to provide as a secondary use, an ashtray or decoration on the top of the toilet paper dispenser.

It is another object of the invention to provide storage for spare rolls of toilet paper.

It is another object of the invention to provide three types of dispensers; a free standing unit and two wall mounted units.

It is another object of the invention to prevent the unrolling of the toilet paper.

It is another object of the invention to give more access to the toilet paper on the wall mounted unit by moving it in or out in close quarters.

SUMMARY OF THE INVENTION

In accordance with the present invention there is provided a toilet paper roll dispenser vertical on a spindle sitting on a plate. The plate prevents the unrolling of the paper as the plate has a raised edge and a diameter larger than the toilet paper roll. The free standing unit could be moved on the floor from one place to another to accomodate the user. The free standing unit allows a decorative plate to be supported by the dispenser. The free standing unit includes storage ability on the pole by removing the plate and spindle from the pole. Two units are wall mounted versions. One fixed on the wall using the same plate and spindle and includes the ability to support the decorative plate on the top of the spindle. A second wall mounted unit is equipped with a flex arm that moves the plate and spindle from right to left a decorative plate can also be supported by the dispenser.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the FIGURES.

DESCRIPTION OF THE PREFERRED EMBODIMENT

Figure 1:
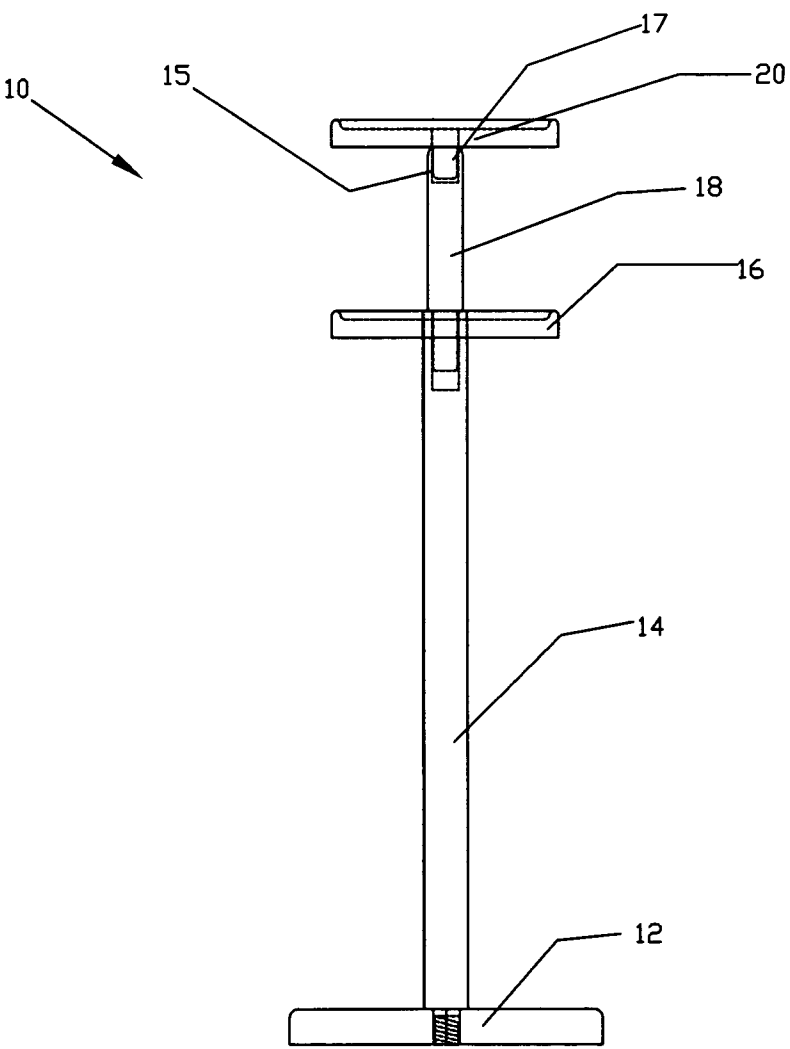
FIG. 1 is a front view of a free standing toilet paper dispenser in accordance with the present invention.

FIG. 1 is a front view of our toilet paper dispenser 10 comprising four major elements: a weighted base or stand 12 having a pole 14 for receiving a subassembly plate 16 and a spindle 18, the subassembly plate 16 has a hole to insert the spindle 18. The spindle 18 is permanently attached to the subassembly plate 16, The spindle 18 has a hollow 15 at the top center to receive a decorative plate 20 and protrusion 17 at the lower portion to be inserted through the plate 16 in the pole 14. The subassembly plate 16 and spindle 18 is removable from the pole 14. This permits storage for extra rolls of toilet paper, not shown, on the pole 14. The decorative plate 20 is easily removable from the top of the spindle 18 to drop a new roll of toilet paper, not shown, into operative position.

Figure 2:
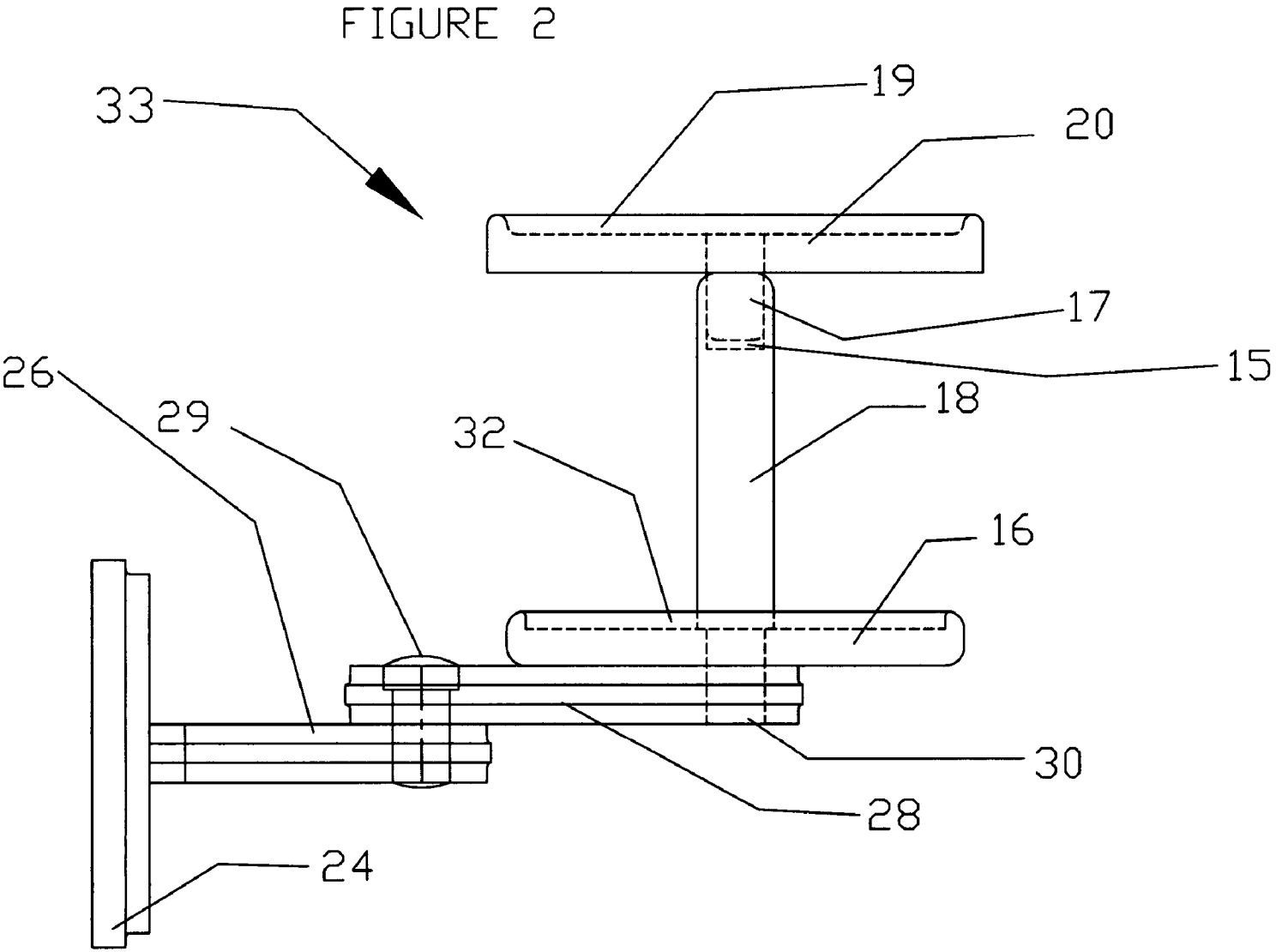
FIG. 2 is a side view of a wall mounted unit having a connected flex arm carrying a plate and spindle supporting a decorative plate.

FIG. 2 is a side view of a wall flex unit 33. A wall mounting plate 24 has a shelf 26, forming a sub assembly. This subassembly supports a flex arm 28 connected with a pivot point 29. The flex arm 28 has a hole to insert the subassembly plate 16 and spindle 18. The flex arm 28 and the subassembly plate 16 and spindle 18 pivots from right to left. The subassembly plate 16 and spindle 18 are used to receive and support the toilet paper roll, not shown, in a recess 32 suitable provided for that purpose. The spindle 18 retains the toilet paper roll when the paper is dispensed. The spindle 18 has a hollow 15 center providing an attachment point for the protrusion 17 of the decorative plate 20. The decorative plate 20 has a recess 19 within its periphery to receive an ashtray or coffee cup, not shown, or decorative art work. Decorative plate 20 is very easy to remove with one hand by lifting upwardly to install a new toilet paper roll on spindle 18.

Figure 3:
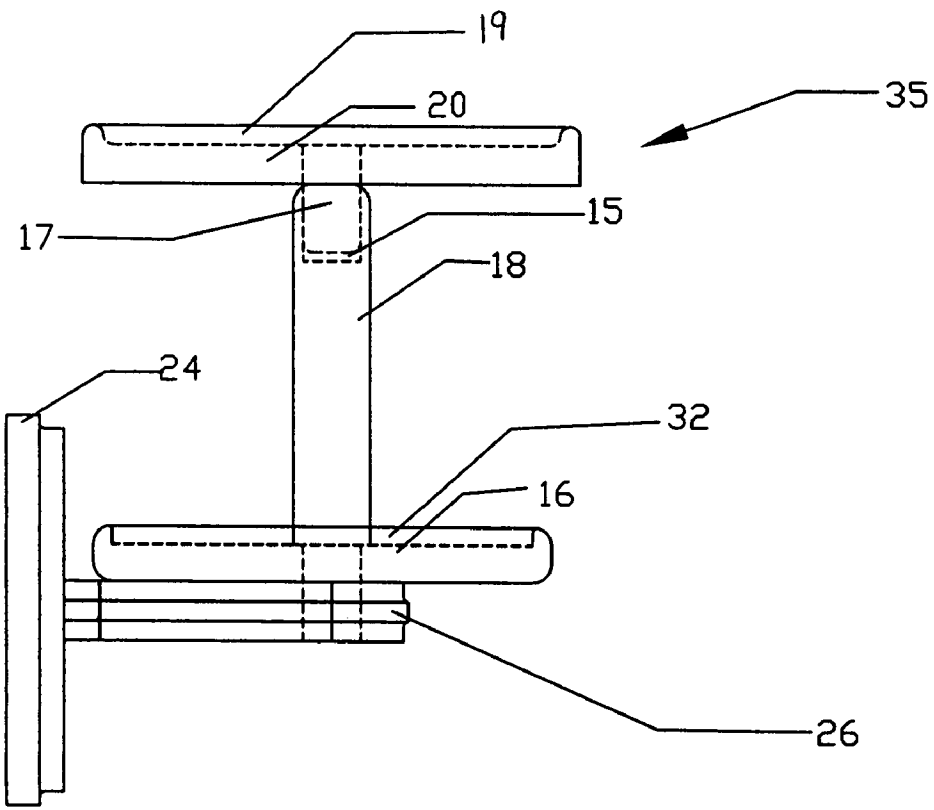
FIG. 3 is a side view of a wall mounted fixed unit.

FIG. 3 is a side view of a assembly of the wall fixed unit 33. The wall mounting plate 24 and shelf 26 are used to attach the unit on the wall, not shown. The shelf 26 has a hole, not shown, to receive the subassembly made of plate 16 and spindle 18. The spindle 18 has a hollow 15 center top to mount the decorative plate 20. The decorative plate 20 is very easy to remove from the spindle 18 for installation of a new toilet paper roll.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. An apparatus for supporting at least one roll of toilet paper, comprising:

a) a base adapted for placement on a horizontal, planar surface;

b) a column having a proximal end and a distal end, supported by and disposed substantially perpendicular to said base, said distal end having a first hollow cavity therein disposed substantially parallel to a major axis of said column;

c) a spindle having a subassembly plate affixed thereto, said subassembly plate being disposed substantially parallel to said base, said spindle having a protruding, proximal portion disposed parallel to and substantially concentrically with said major axis of said column and adapted for slidable retention in said first hollow cavity, and a distal portion having a second hollow cavity disposed therein, said second hollow cavity disposed substantially parallel to a major axis of said spindle; and d) a substantially horizontal top plate having an upper surface and a recess formed therein, said top plate having a protruding member disposed on a bottom surface thereof, said protruding member being sized and configured for slidable retention in said second hollow cavity;

whereby a roll of toilet paper may be slidably placed over said spindle, supported by said subassembly plate, and secured on said spindle between said subassembly plate and said top plate without fasteners.

2. The apparatus for supporting at least one roll of toilet paper in accordance with claim 1, wherein said column is sized and configured to receive at least one additional roll of toilet paper thereupon.

3. The apparatus for supporting at least one roll of toilet paper in accordance with claim 1, wherein said base comprises a weighted base.

4. The apparatus for supporting at least one roll of toilet paper in accordance with claim 1, wherein said recess is adapted to receive and contain at least one item from the group: an ash tray, a coffee cup, and decorative artwork.

5. The apparatus for supporting at least one roll of toilet paper in accordance with claim 1, wherein said at least one roll of toilet paper is supported in a substantially vertical orientation with a hollow core thereof placed over said spindle.

6. An apparatus for supporting at least one roll of toilet paper comprising:

a) a mounting plate adapted for attachment to a vertical surface;

b) a horizontal shelf attached to said mounting plate, said shelf comprising a first, vertically aligned hollow cavity disposed in an upper surface thereof;

c) a spindle having a protruding, proximal portion adapted for slidable retention in said first, vertically aligned hollow cavity, and a distal portion having a second hollow cavity disposed therein, said second cavity being substantially concentric with said spindle;

d) a subassembly plate affixed to said spindle and disposed substantially perpendicular to a major axis thereof; and e) a substantially horizontal top plate having an upper surface and a recess formed therein, said top plate having a protruding member disposed on a bottom surface thereof, said protruding member being sized and configured for slidable retention in said second hollow cavity;

whereby a roll of toilet paper may be slidably placed over said spindle, supported by said subassembly plate, and secured on said spindle between said subassembly plate and said top plate without fasteners.

7. The apparatus for supporting at least one roll of toilet paper in accordance with claim 6, wherein said recess is adapted to receive and contain at least one item from the group: an ash tray, a coffee cup, and decorative artwork.

8. The apparatus for supporting at least one roll of toilet paper in accordance with claim 6, wherein said at least one roll of toilet paper is supported in a substantially vertical orientation with a hollow core thereof placed over said spindle.

* * * * *